US006999109B2

(12) United States Patent
Yi et al.

(10) Patent No.: US 6,999,109 B2
(45) Date of Patent: Feb. 14, 2006

(54) LIGHT BEAM SCANNING APPARATUS WITH AN IMAGE HEAD

(75) Inventors: Jong-Su Yi, Kyunggi-Do (KR); Sang-Kyeong Yun, Kyunggi-Do (KR)

(73) Assignee: Samsung Electro-Mechanics Co., Ltd., Kyunggi-do (KR)

( * ) Notice: Subject to any disclaimer, the term of this patent is extended or adjusted under 35 U.S.C. 154(b) by 145 days.

(21) Appl. No.: 10/632,796

(22) Filed: Aug. 4, 2003

(65) Prior Publication Data

US 2004/0218031 A1 Nov. 4, 2004

(30) Foreign Application Priority Data

Apr. 30, 2003 (KR) ..... 10-2003-0027673

(51) Int. Cl.
*B41J 27/00* (2006.01)

(52) U.S. Cl. ..... 347/244; 347/258

(58) Field of Classification Search ..... 347/232, 347/233, 238, 241–242, 244, 256–258; 313/15
See application file for complete search history.

(56) References Cited

U.S. PATENT DOCUMENTS 4,672,258 A * 6/1987 Konishi ..... 313/15
4,918,465 A * 4/1990 Morita ..... 347/232
6,456,313 B1 * 9/2002 Hiyoshi ..... 347/238

FOREIGN PATENT DOCUMENTS

JP 11-28833 2/1999

* cited by examiner

*Primary Examiner*—Hai Pham
(74) *Attorney, Agent, or Firm*—Morgan, Lewis & Bockius LLP

(57) ABSTRACT

A light beam scanning apparatus is constructed so that light beams scanned from an image head form spots on a photosensitive drum to form an image. The image head includes a light emitting device and a lens system. The light emitting device has a plurality of light emitting sources arranged to be perpendicular to a rotation axis of the photosensitive drum to output multiple beams in response to video signals. The lens system allows the multiple beams output from the light emitting device form spots on surface of the photosensitive drum in a linear shape along vertical direction of the surface thereof.

17 Claims, 12 Drawing Sheets

FIG. 1 *Prior Art*
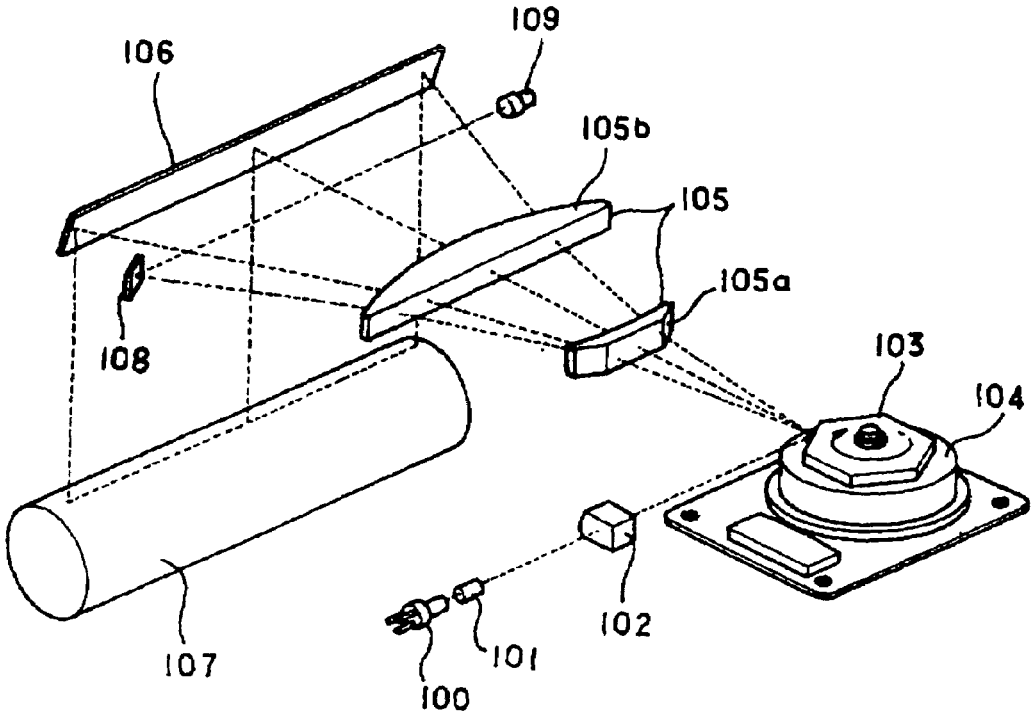

LIGHT BEAM SCANNING APPARATUS WITH AN IMAGE HEAD

BACKGROUND OF THE INVENTION

1. Field of the Invention

The present invention relates generally to a light beam scanning apparatus in an image forming system, and more particularly to a light beam scanning apparatus in an image forming system, in which a light emitting means within an image head is arranged to be perpendicular to a rotation axis of a photosensitive drum in the light beam scanning apparatus in which light beams scanned from the image head form spots on the photosensitive drum to form an image, thus simultaneously printing a plurality of lines and enabling the image to be uniform.

2. Description of the Related Art

Generally, a light beam scanning apparatus is a device for forming an image by scanning light beams to form a spot on a photoconductor medium in image forming systems, for example, a laser printer, a Light Emitting Diode (LED) printer, an electronic photocopier, a word processor machine and the like.

With the recent trend toward the miniaturization, high speed and high resolution of image forming systems, the light beam scanning apparatus has been continuously researched and developed to have characteristics of miniaturization, high speed, and high resolution to meet the trend of the image forming systems.

The light beam scanning apparatus of an image forming system is classified into a laser scanning type using an f·θ lens and an image head print type, depending on a light beam scanning manner and the construction of a light beam scanning apparatus.

FIG. 1 is a view showing a conventional laser scanning-type light beam scanning apparatus using an f·θ lens. As shown in FIG. 1, the conventional laser scanning-type light beam scanning apparatus comprises a Laser Diode (LD) 100, a collimator lens 101, a cylinder lens 102, a polygon mirror 103, a polygon mirror driving motor 104, an f·θ lens 105, an image formation reflecting mirror 106, a horizontal synchronizing mirror 108, and an optical sensor 109. The LD 100 emits a light beam in response to a video signal. The collimator lens 101 converts the light beam emitted from the LD 100 to a parallel light beam, and the cylinder lens 102 converts the parallel light beam having passed through the collimator lens 101 to a linear light beam horizontal to a scanning direction. The polygon mirror 103 scans the linear light beam having passed through the cylinder lens 102 by moving the linear light beam at a constant linear velocity. The polygon mirror driving motor 104 rotates the polygon mirror 103 at a constant velocity. The f·θ lens 105 has a certain refractive index with respect to an optic axis, and focuses a light beam on a scanning surface by deflecting a light beam with a constant angular velocity, reflected from the polygon mirror 103, in a main scanning direction and correcting aberrations. The reflecting mirror 106 reflects the light beam having passed through the f·θ lens 105 in a predetermined direction to allow the light beam to form a spot on the surface of a photosensitive drum 107, which is an image formation surface. The horizontal synchronizing mirror 108 horizontally reflects the laser beam having passed through the f·θ lens 105. The optical sensor 109 receives the laser beam reflected from the horizontal synchronizing mirror 108 and synchronizes the laser beam.

Therefore, the laser scanning-type laser light scanning apparatus is constructed so that the light beam output from the LD pass through the collimator lens to be converted to the parallel beam, the parallel beam is focused in the direction of a rotation axis of the polygon mirror by the cylinder lens and then reflected by the polygon mirror rotating at a constant angular velocity, and the reflected light beam passes through the f·θ lens and thereafter forms a spot on the photosensitive drum to have a certain radius thereof. In this case, since the resolution of a printer is determined by the radius of the spot formed on the photosensitive drum, the processing ability of the f·θ lens must be excellent.

However, in the light beam scanning apparatus, miniaturization and cost must be generally considered. Therefore, each f·θ lens is comprised of a Y-toric lens, an anamorphic lens, a free-formed surface and the like so as to reduce the number of f·θ lenses. That is, it is very difficult to process a surface of such an f·θ lens, thus deteriorating the processing ability thereof. As a result, the performance and resolution of the light beam scanning apparatus decreases.

Moreover, in order to obtain the linearity of a light beam, theta θ must be reduced. However, f must increase to reduce θ. Consequently, the laser scanning-type light beam scanning apparatus is disadvantageous in that, if f increases, the size of the light beam scanning apparatus increases, so that it is difficult to implement a miniaturized printer device.

FIGS. 2*a* to 2*c* are view showing a conventional image head print-type light beam scanning apparatus which scans light beams on a photosensitive drum using an image head.

Referring to FIGS. 2*a* and 2*b*, the light beam scanning apparatus comprises a photosensitive drum 200 and an image head 210 including a LD array 211 arranged in parallel to a rotation axis of the photosensitive drum 200.

While the image head, 210 is transferred in the direction of "S" by a transfer means (not shown), the plural LDs or LEDs provided in the image head 210 emit multiple beams in response to input video signals, and the emitted beams form a spot on the surface of the photosensitive drum 200 by a lens array, such as a minus lens and a plus lens, as shown in FIG. 2*c*.

Such an image head print-type light beam scanning apparatus is advantageous in that, since the image head 210 can be arranged to be closer to the photosensitive drum 200, the light beam scanning apparatus can be miniaturized compared to the laser scanning-type light beam scanning apparatus using the f·θ lens.

However, the image head print-type light beam scanning apparatus is problematic in that, since the image head is arranged in parallel with the rotation axis of the photosensitive drum, a printing speed depends on a transfer speed of the image head, so that the printing speed becomes lower than that of the laser scanning-type light beam scanning apparatus using the f·θ lens. Further, the image head print-type light beam scanning apparatus is problematic in that, since the LD array 211 is arranged within the image head 210 in a row along a longitudinal direction of the photosensitive drum 200, only one line can be printed at a time. Further, there is a problem in that, if the transfer speed of the image head is increased, the costs of related parts are increased and the resolution is deteriorated. Further, there is an attempt to widen a space for receiving LDs in the image head to allow an LD array to be extended and arranged along the longitudinal direction of the photosensitive drum. However, this attempt is problematic in that the increase in the number of LDs becomes a factor in increasing costs, and the assembly precision of the LD array is decreased, thus the performance of a printer is deteriorated.

Consequently, according to the image head print-type light beam scanning apparatus in which the LD array is arranged in parallel with the rotation axis of the photosensitive drum, other efforts to increase a printing speed contain fundamental problems in the aspects of costs, resolution and printer performance.

SUMMARY OF THE INVENTION

Accordingly, the present invention has been made keeping in mind the above problems occurring in the prior art, and an object of the present invention is to provide a light beam scanning apparatus, in which a light emitting means within an image head is arranged to be perpendicular to a rotation axis of a photosensitive drum in the light beam scanning apparatus in which light beams scanned from the image head form spots on the photosensitive drum to form an image, thus simultaneously printing two or more lines and enabling the image to be uniform.

In order to accomplish the above object, the present invention provides a light beam scanning apparatus, in which light beams scanned from an image head form spots on a photosensitive drum to form an image, the image head comprising a light emitting means comprised of a plurality of light emitting sources arranged to be perpendicular to a rotation axis of the photosensitive drum to output multiple beams in response to video signals; and a lens system for allowing the multiple beams output from the light emitting means to form spots on a surface of the photosensitive drum in a linear shape along a vertical direction of the surface thereof.

Preferably, the lens system comprises a collimator lens for converting the multiple beams emitted from the light emitting means to parallel beams; a cylinder lens for refracting the multiple beams, converted to the parallel beams by the collimator lens, in the main scanning direction; and a plus lens for focusing the multiple beams having passed through the cylinder lens on the photosensitive drum.

Further, the present invention provides a light beam scanning apparatus, in which light beams scanned from an image head form spots on a photosensitive drum to form an image, the image head comprising a light emitting source; a collimator lens for converting a light beam emitted from the light emitting source to a parallel beam; an optical modulator for modulating the light beam, converted to the parallel beam by the collimator lens, to generate multiple beams; and a lens system for allowing the multiple beams output from the optical modulator to form spots on a surface of the photosensitive drum in a linear shape along a vertical direction of the surface thereof.

Preferably, the lens system comprises a cylinder lens for refracting the multiple beams output from the optical modulator in the main scanning direction; and a plus lens for focusing multiple beams having passed through the cylinder lens on the photosensitive drum.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a conventional laser scanning-type light beam scanning apparatus which scans light beams onto a photosensitive drum using an f·θ lens;

DESCRIPTION OF THE PREFERRED EMBODIMENTS

Hereinafter, embodiments of the present invention will be described in detail with reference to the attached drawings.

The characteristics of a light beam scanning apparatus of the present invention are compared with those of the conventional image head print-type light beam scanning apparatus of FIG. 2*a* as will be described below. That is, the conventional image head print-type light beam scanning apparatus of FIG. 2*a* is constructed in such a way that a light emitting means accommodated in an image head is arranged in parallel with a rotation axis of a photosensitive drum, while the light beam scanning apparatus of the present invention is constructed in such a way that a light emitting means accommodated in the image head is arranged to be perpendicular to a rotation axis of a photosensitive drum.

Figure 2A:
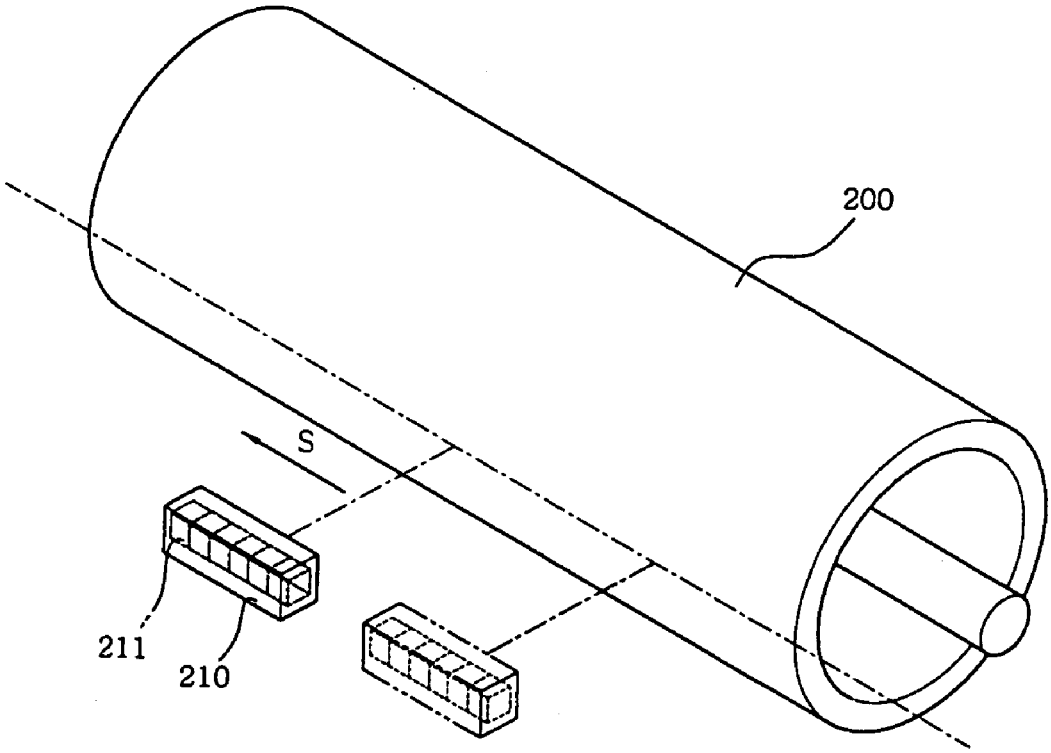
FIG. 2a PRIOR ART
FIGS. 2*a* to 2*c* are a perspective view, a front view and a side view of a conventional image head print-type light beam scanning apparatus which scans light beams onto a photosensitive drum using an image head, respectively.
Figure 2B:
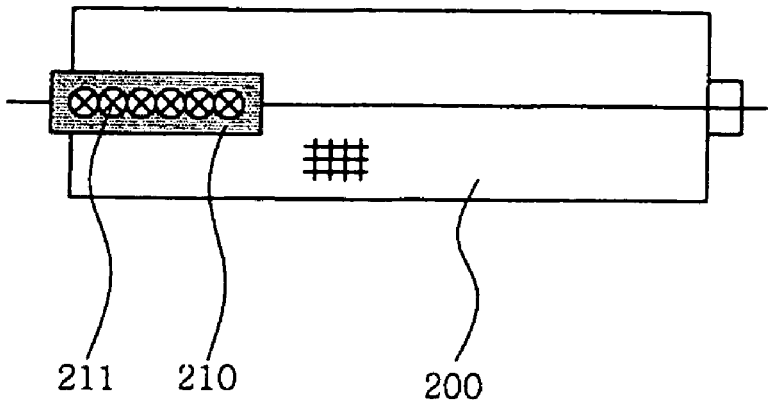
FIG. 2b PRIOR ART

Further, the conventional image head print-type light beam scanning apparatus of FIG. 2*a* is constructed in such a way that the focus of output multiple beams exists on the surface of the photosensitive drum, while the light beam scanning apparatus of the present invention is constructed in such a way that the focus of output multiple beams exists at the central axis of the photosensitive drum.

Figure 2C:
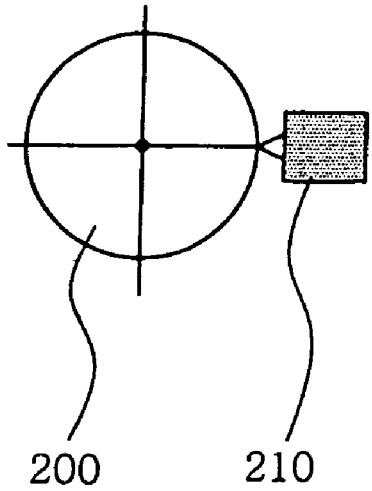
FIG. 2c PRIOR ART

Therefore, as shown in FIG. 2*c*, since the conventional image head print-type light beam scanning apparatus forms a dot-shaped spot on the surface of the photosensitive drum, the image head prints one line while moving in the longitudinal direction (direction of "S") by a stage. On the contrary, since the light beam scanning apparatus of the present invention forms spots in a linear shape on the surface of the photosensitive drum along the vertical direction of the surface thereof as shown in FIGS. 3*a* and 3*b*, the image head can uniformly print at least two lines while moving in the lateral direction (direction of "S") by a stage.

In this case, even though a light emitting means accommodated in the image head is arranged to be only perpendicular to the rotation axis of the photosensitive drum, a dot-shaped spot is formed if the focus of output multiple beams exists on the surface of the photosensitive drum.

Thus, a uniform printing operation of at least two lines proposed in the present invention cannot be performed. Consequently, the present invention proposes a light beam scanning apparatus in which the focus of output multiple beams exists at the central axis of the photosensitive drum to vertically form spots in a linear shape on surface of the photosensitive drum, thus printing two or more lines and increasing the resolution of the light beam scanning apparatus using optical properties of light.

Figure 3A:
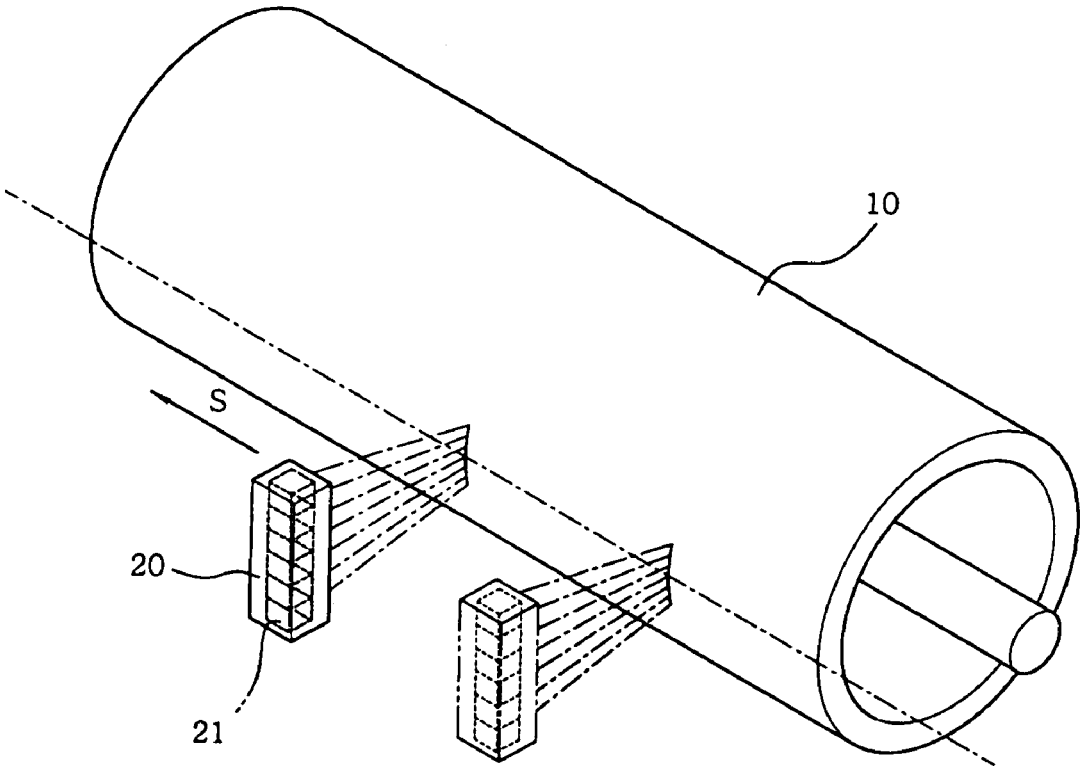
FIGS. 3*a* and 3*b* are a perspective view and a front view of a light beam scanning apparatus according to the present invention, respectively.
Figure 3B:
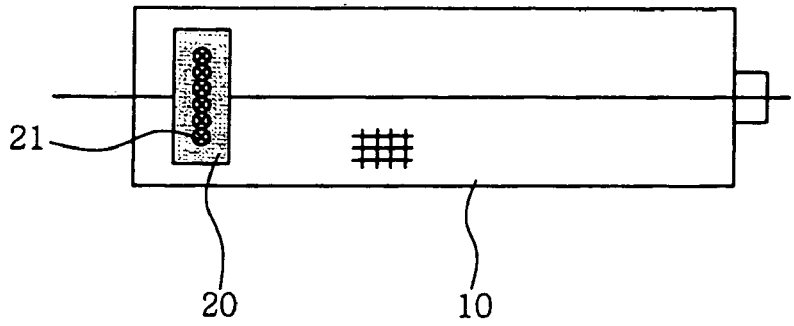

FIGS. 3*a* and 3*b* are views showing the light beam scanning apparatus according to the present invention. The light beam scanning apparatus comprises a photosensitive drum 10 and an image head 20 including a plurality of light emitting sources 21 which emit multiple beams to the photosensitive drum 10.

The photosensitive drum 10 is cylindrically formed to rotate by a photosensitive drum rotating means (not shown). On the surface of the photosensitive drum 10, a highly photosensitive material, such as a silver halide film, is applied. Therefore, light emitting sources with low output intensities can be used as the light emitting sources 21 which form an image on the photosensitive drum 10.

The image head 20 comprises the plurality of light emitting sources 21 arranged to be perpendicular to the rotation axis of the photosensitive drum 10, and is transferred in the direction of "S" parallel to the rotation axis of the photosensitive drum 10 by a transfer means (not shown).

While the image head 20 is transferred in the direction of "S", the plurality of light emitting sources 21 provided in the image head 20 emit multiple beams in response to input video signals to form spots on the surface of the photosensitive drum 10.

Figure 4:
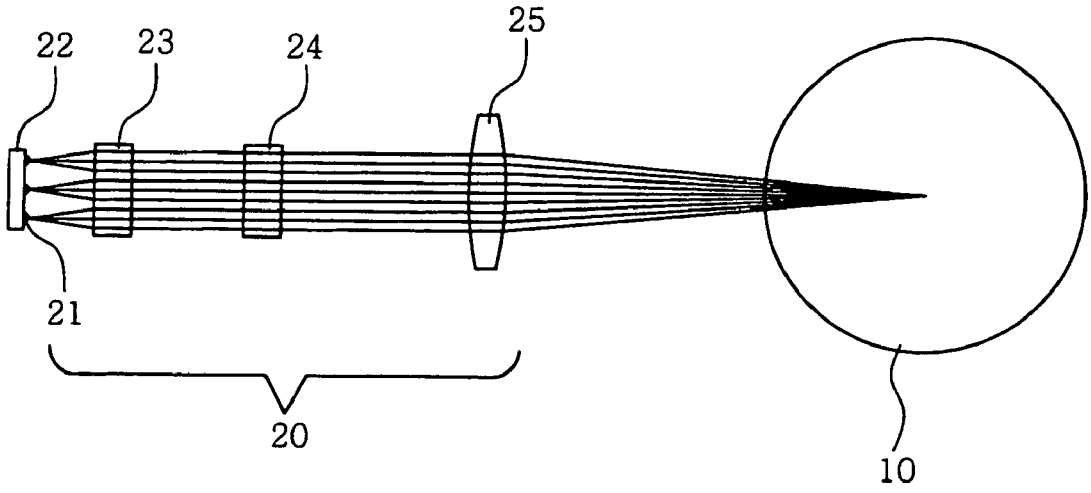
FIG. 4 is a view showing the interior of an image head according to the present invention.

FIG. 4 is a view showing the interior of the image head of FIGS. 3*a* and 3*b*, wherein a path of the multiple beams of the present invention is depicted.

Referring to FIG. 4, the image head 20 comprises a light emitting means 22 comprised of the plurality of light emitting sources 21 arranged to be perpendicular to the rotation axis of the photosensitive drum 10 to emit multiple beams in response to video signals, and a lens system for allowing the multiple beams emitted from the light emitting means 22 to vertically form spots in a linear shape on the surface of the photosensitive drum 10.

The light emitting means 22 outputs light beams corresponding to video signals input by a video signal input means (not shown) as multiple beams.

The light emitting means 22 is a light emitting array, and is comprised of the plural light emitting sources consisting of LDs or LEDs. Since each of the light emitting sources, such as LDs or LEDs, emits a light beam, the light emitting means 22, that is, the light emitting array, outputs multiple beams.

The multiple beams emitted from the light emitting means 22 form spots in a linear shape along the vertical direction of the surface of the photosensitive drum 10 through the lens system.

Preferably, the lens system may be constructed to comprise a lens 23 for converting the multiple beams emitted from the light emitting means 22 to beams parallel to an optic axis, a cylinder lens 24 for refracting the multiple beams, converted to the parallel beams through the lens 23, only in a main scanning direction, and a plus lens 25 for focusing the multiple beams having passed through the cylinder lens 24 on the photosensitive drum 20.

The multiple beams emitted from the light emitting means 22 are converted to the parallel beams through the lens 23, and thereafter the parallel beams pass through the cylindrically formed cylinder lens 24. The cylinder lens 24 refracts the incident beams only in the main scanning direction. Therefore, the parallel beams having passed through the cylinder lens 24 are refracted in the main scanning direction, not in a sub-scanning direction. This refracting operation becomes a factor in varying the positions of spots formed on the photosensitive drum 10 in the main scanning direction and in the sub-scanning direction, respectively. In this case, the sub-scanning direction represents the longitudinal direction of the photosensitive drum 10 in parallel with the rotation axis of the photosensitive drum 10, and the main scanning direction represents the vertical direction of the photosensitive drum 10.

After that, the multiple beams having passed through the cylinder lens 24 are focused on the central axis of the photosensitive drum 10 to form a spot at the central axis thereof while passing through the plus lens 25. While the multiple beams are focused on the central axis of the photosensitive drum 10, beams going straight collide with the surface of the photosensitive drum 10 to form spots on the surface thereof.

That is, theoretically, the multiple beams focused through the plus lens 25 form a spot on the central axis of the photosensitive drum 10 when viewed in the sub-scanning direction, as shown in FIG. 4. However, actually, the multiple beams collide with the surface of the photosensitive drum 10 to form spots on the surface thereof when viewed in the main scanning direction. Further, since as many spots as the number of light emitting sources 21 of the light emitting means 22 are formed, the spots are actually formed in a linear shape on the surface of the photosensitive drum 10 perpendicular to the rotation axis thereof.

As described above, in the light beam scanning apparatus of the present invention, the focuses of the light beams viewed in the main scanning direction and the sub-scanning direction vary by the cylinder lens 24 that primarily refracts light beams only in the main scanning direction. The multiple beams having different focuses are secondarily focused on the plus lens 25, so that light beams are focused on the central axis of the photosensitive drum 10 when viewed in the sub-scanning direction, while the light beams are focused on the surface thereof when viewed in the main scanning direction, more specifically, the surface perpendicular to the rotation axis of the photosensitive drum 10.

Figure 5:
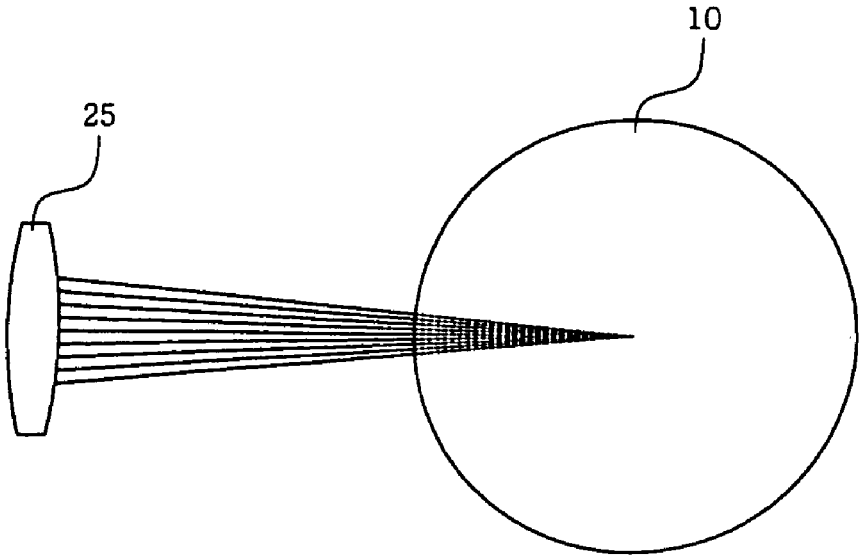
FIGS. 5 and 6 are partial schematic views showing the image head according to the present invention.

FIG. 5 is a partial schematic view showing the plus lens of the image head of FIG. 4 and the photosensitive drum. In this case, reference numeral 25 designates the plus lens, and reference numeral 10 designates the photosensitive drum. Further, a solid line represents a path of multiple beams having passed through the plus lens 25 and focused on the central axis of the photosensitive drum 10, and a dotted line represents a path of multiple beams which will form a dot-shaped spot at the central axis of the photosensitive drum 10 if the multiple beams do not collide with the surface of the photosensitive drum 10.

Referring to FIG. 5, parallel beams are refracted by the plus lens 25 at the same angle, and are then perpendicularly incident on the surface of the photosensitive drum 10 to form spots on the surface of the photosensitive drum 10. In this case, the multiple beams are perpendicularly incident on the surface of the photosensitive drum 10 and the ultimate focus of the multiple beams exists at the central axis of the photosensitive drum 10. Therefore, the sizes of the spots formed on the surface of the photosensitive drum 10 are equal, and distances between respective spots are also equal.

Since the light beam scanning apparatus of the present invention employs a plurality of LDs or LEDs as light emitting sources, the spots on the surface of the photosensitive drum 10 form a linear shape perpendicularly along the surface thereof, thus forming an image.

Allowing the multiple beams to be perpendicularly incident on the surface of the photosensitive drum 10, the ultimate focus of the beams viewed in the sub-scanning direction to exist at the central axis of the photosensitive drum 10 and the focus of the beams viewed in the main scanning direction to exist at the surface of the photosensitive drum 10, depends on the curvature of the cylinder lens 24, a distance between the cylinder lens 24 and the plus lens 25, and a focal length of the plus lens 25.

That is, light beams are refracted in the main scanning direction by the curvature of the cylinder lens 24. Further, the distance between the cylinder lens 24 and the plus lens 25 is a refraction distance of the light beams refracted in the main scanning direction. Therefore, the curvature of the cylinder lens 25 and the distance between the cylinder lens 24 and the plus lens 25 are conclusive factors that vary the focuses of light beams viewed in the main scanning direction and the sub-scanning direction, and allow the light beams to be perpendicularly incident on the surface of the photosensitive drum 10 in the main scanning direction.

Further, the focal length of the plus lens 25 is a conclusive factor in allowing the focus of light beams viewed in the sub-scanning direction to be positioned at the central axis of the photosensitive drum 10.

The present invention controls the three factors, that is, the curvature of the cylinder lens, the distance between the cylinder lens and the plus lens, and the focal length of the plus lens in conjunction with each other, thus enabling the focus of light beams viewed in the sub-scanning direction to be positioned at the central axis of the photosensitive drum 10 and the focus of light beams viewed in the main scanning direction to be positioned at the surface of the photosensitive drum 10.

Figure 6:
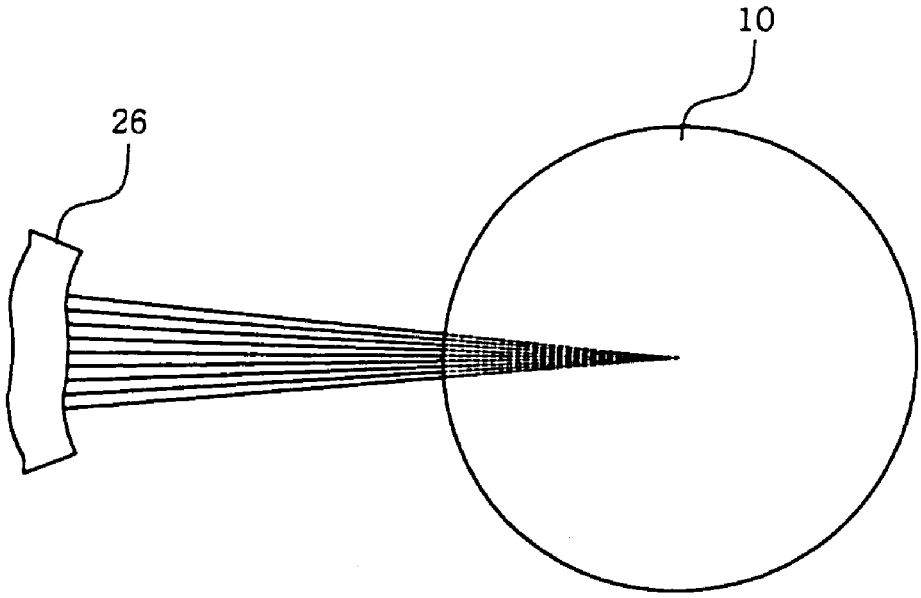

In relation to these operations, the present invention is designed so that the cylinder lens 24 and the plus lens 25 are implemented as a single equivalent aspheric lens 26, as shown in FIG. 6, thus obtaining the same effect as the embodiment of FIG. 5.

The equivalent lens 26 is a Y-toric, aspheric lens in which the cylinder lens 24 and the plus lens 25 are integrated into a single lens. The aspheric lens has different dioptric powers in the main scanning direction and the sub-scanning direction, respectively. Therefore, positions at which spots will be ultimately formed in the main scanning direction and the sub-scanning direction may differ. Further, the focus of the aspheric lens is placed at the central axis of the photosensitive drum, so that the spots of light beams can be formed perpendicularly to the surface of the photosensitive drum.

Figure 7:
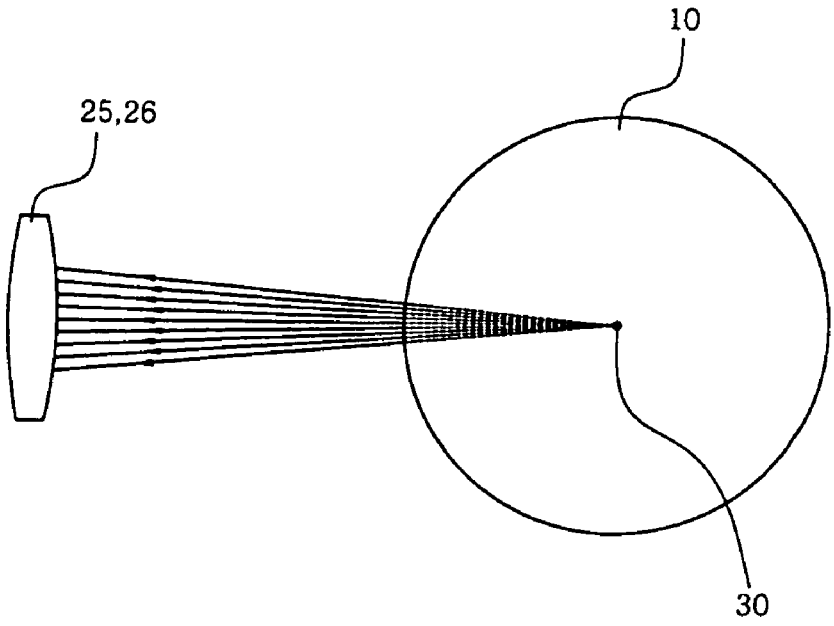
FIG. 7 is a view showing an example in which a light source virtually provided at the central axis of a photosensitive drum emits light beams within the range of a certain angle.

The above-described embodiment can be compared to a construction in which a light source 30 arranged virtually at the central axis of the photosensitive drum 10 emits light beams within the range of a certain angle, as shown in FIG. 7. When the light source 30 emits light beams at equal angles within the range of a certain angle, spots are uniformly formed on the surface of the photosensitive drum 10 at regular intervals. In consideration of the dispersion of light, innumerable continuous spots are actually formed in a linear shape on the surface of the photosensitive drum. In this case, the length of the liner shape defined by the continuous spots forming the linear shape corresponds to an image formed on the photosensitive drum, which is printed on a recording medium through a printing means (not shown).

Therefore, in the present invention, lines corresponding to the length of the linear shape are formed on the photosensitive drum, and, specifically, two or more lines can be simultaneously printed. Consequently, a printing speed theoretically increases by the length of the linear shape formed on the photosensitive drum, and increases at least twice.

Figure 8:
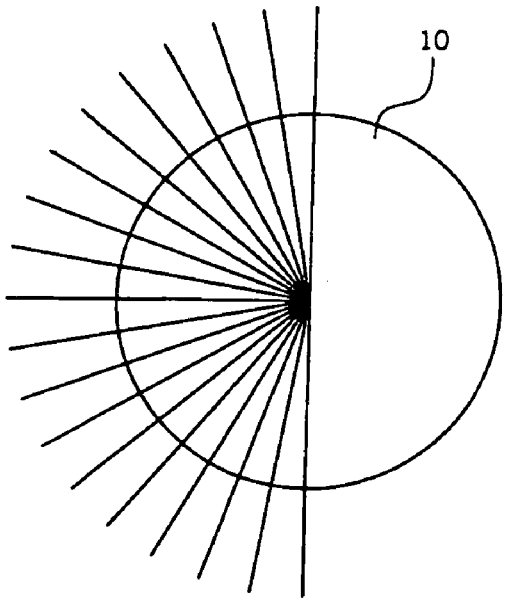
FIG. 8 is a view showing an example in which spots are formed to have a maximum linear length according to the present invention.

FIG. 8 is a view showing an example in which spots form a linear shape with a maximum length. For ease of understanding the present invention, the spots are exaggerated in FIG. 8. Referring to FIG. 8, all multiple beams focused from a plus lens or Y-toric lens are incident on the entire front surface of the photosensitive drum 10, and the focus of the multiple beams exists at the central axis of the photosensitive drum 10.

Therefore, if there is no difficulty in increasing the size of the light beam scanning apparatus, the multiple beams focused from the plus lens or Y-toric lens can be uniformly incident on the entire front surface of the photosensitive drum 10 at equal incident angles. If this operation is possible, an image corresponding to the circumference of a semicircle of the photosensitive drum 10 would be formed in a linear shape.

As described above, the light emitting means 22 comprised of the plurality of light emitting sources 21 is arranged to be perpendicular to the rotation axis of the photosensitive drum 10, and multiple beams emitted from the light emitting means 22 pass through the lens system 20, preferably, the collimator lens 23, the cylinder lens 24 and the plus lens 25. Thus, the focus of the light beams can be positioned at the central axis of the photosensitive drum 10 in the sub-scanning direction, and the spots of light beams can be formed in a linear shape on the surface of the photosensitive drum along the vertical direction of the surface thereof in the main scanning direction.

Meanwhile, since the spots formed in the linear shape on the surface of the photosensitive drum along the vertical direction have a waist according to the diffraction of light, the spots of light beams viewed in the main scanning direction are uniform if the linear-shaped spot area of light beams viewed in the main scanning direction is placed within the waist, thus providing the light beam scanning apparatus having an uniform image.

Figure 9A:
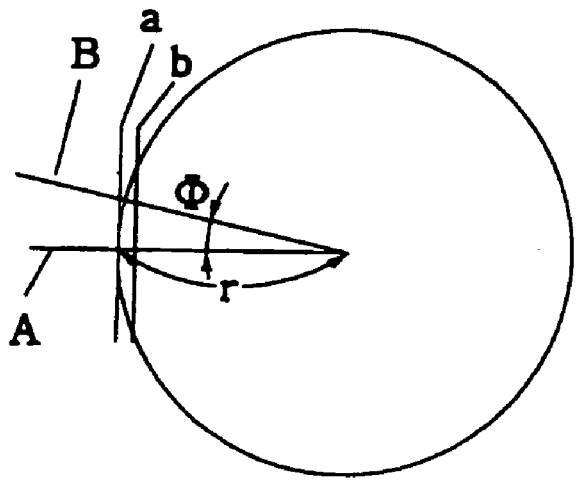
FIGS. 9*a* and 9*b* are views showing the focus of light beams viewed in a main scanning direction according to the present invention.

FIG. 9*a* is a view showing the focus of light beams viewed in the sub-scanning direction to describe spots of light beams formed in the main scanning direction. As shown in FIG. 9*a*, the focus of the light beams viewed in the sub-scanning direction is placed at the central axis of the photosensitive drum. In FIG. 9*a*, reference character "A" represents a central ray viewed in the sub-scanning direction, having passed through the central axis of the lens and incident on the photosensitive drum 10, and reference character "B" represents a marginal ray focused from an uppermost portion of the lens and incident on the photosensitive drum 10 when viewed in the sub-scanning direction. Further, reference character "r" represents a radius of the photosensitive drum 10, reference character "$\phi$" represents an angle between the central ray "A" and the marginal ray "B", and reference characters "a" and "b" represent linear-shaped spot areas formed on the surface of the photosensitive drum 10 along the vertical direction of the surface. That is, "a" is an outermost point in the radial direction of the photosensitive drum 10 and "b" is an innermost point in the radial direction when multiple beams are formed on the photosensitive drum 10 in the linear shape.

Figure 9B:
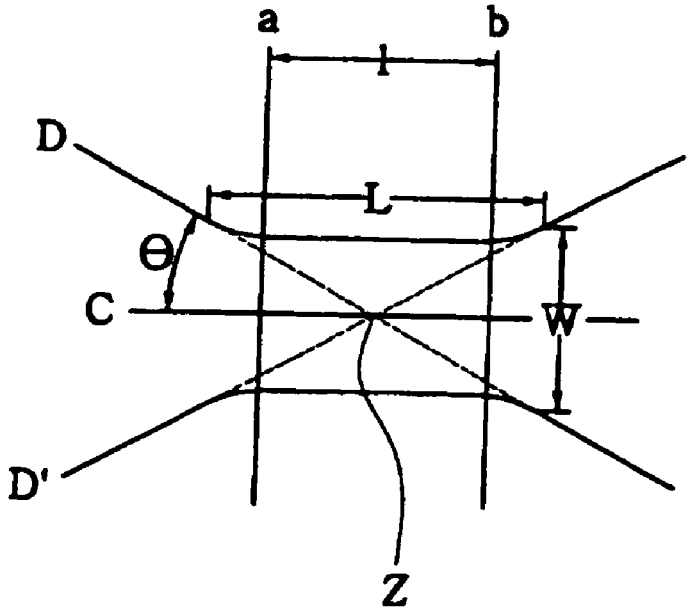

Further, FIG. 9*b* is a view showing the focus of light beams viewed in the main scanning direction. As shown in FIG. 9*b*, spots are formed on the surface of the photosensitive drum 10 when viewed in the main scanning direction.

In this case, reference character "C" represents a central ray passing through the central axis of the lens when viewed in the main scanning direction, reference characters "D" and "D'" represent marginal rays focused from an uppermost portion of the lens and incident on the photosensitive drum when viewed in the main scanning direction, a waist "W" represents a size of an area of spots when viewed in the main scanning direction, "l" represents a straight distance between "a" and "b", "L" represents a length of "W", and "θ" represents an angle between the central ray "C" and the marginal ray "D" or "D'".

At this time, in order to uniformly maintain the size of the area of spots viewed in the main scanning direction, the focus of the plus lens 25 or the equivalent lens 26 needs only exist between "a" and "b". Ideally, the focus of the equivalent lens 26 must exist at the position "Z". However, since the waist "W" is formed due to the waist effect of light, as shown in FIG. 9*b*, the focus of the equivalent lens 26 needs only exist between "a" and "b". Therefore, the focal length has an allowance.

In this case, θ is expressed by Equation [1], $$\theta = \frac{2\lambda}{(\Pi \cdot W)} \quad [1]$$

where λ is a wavelength of the marginal ray.

Further, l is a period during which the spots of the light beams become uniform due to diffraction effect, and is expressed by Equation [2].

$$l = r(1-\cos\theta) \quad [2]$$

Further, L is the length of the waist W, and is expressed by Equation [4] derived from Equation [3].

$$\tan\theta = \frac{W/2}{L/2} = \frac{W}{L} \quad [3]$$

$$L = \frac{W}{\tan\theta} \quad [4]$$

Further, since the period during which the spots of the light beams become uniform due to the diffraction effect must be within the waist W, Equation [5] is satisfied.

$$l < L \quad [5]$$

Therefore, Equation [6] is satisfied.

$$r(1-\cos\phi) < \frac{W}{\tan\theta} \quad [6]$$

Therefore, the waist W is expressed by Equation [7].

$$W > r(1-\cos\phi)\tan\theta \quad [7]$$

Consequently, if the condition W>r(1−cos ϕ)tan θ is satisfied, the sizes of the spots become uniform even when viewed in the main scanning direction, thus obtaining a satisfactory uniform image.

As described above, in the light beam scanning apparatus of the present invention, the focus of a light beam scanning lens is positioned at the central axis of the photosensitive drum 10 when viewed in the sub-scanning direction by the operation of the cylinder lens 24 and the plus lens 25, or the Y-toric lens 26 in which the cylinder lens 24 and the plus lens 25 are integrated into a single lens. Further, spots can be uniformly formed on the surface of the photosensitive drum 10 at regular intervals when viewed in the sub-scanning direction. Further, the condition W>r(1−cos ϕ)tan θ is satisfied in the main scanning direction, so that spots can be uniformly formed.

Therefore, spots can be formed in a linear shape with a predetermined length on the surface of the photosensitive drum 10 perpendicular to the rotation axis thereof, thus simultaneously printing two or more lines while obtaining satisfactory resolution.

Figure 10:
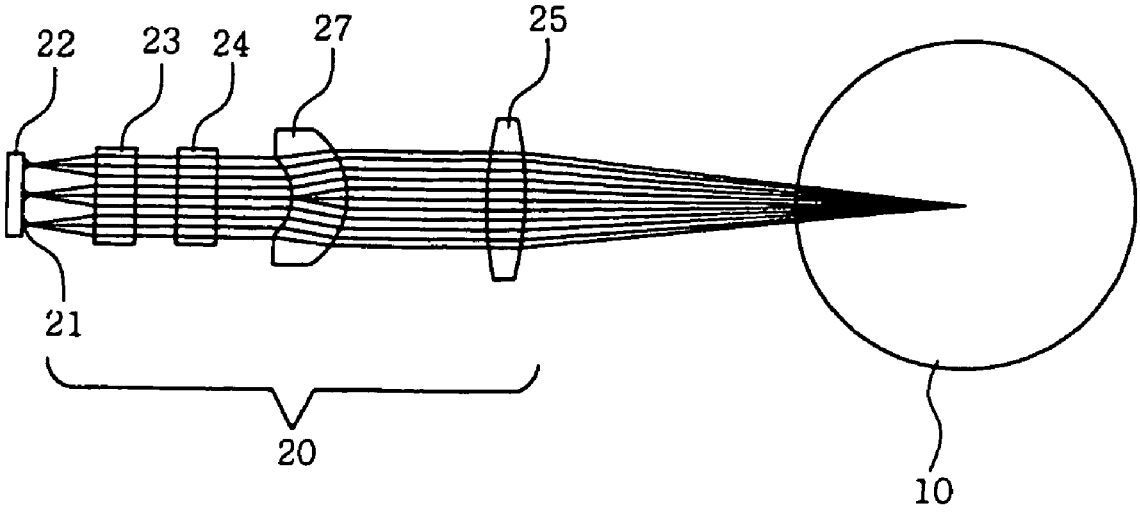
FIG. 10 is a view showing an embodiment in which a minus lens is further included in the light beam scanning apparatus of FIG. 4.

Further, as shown in FIG. 10, the present invention can be constructed to further comprise a minus lens 27 between the cylinder lens 24 and the plus lens 25. Since the minus lens 27, a typical concave lens, outwardly diffracts light beams having passed through the cylinder lens 24, and the dispersed light beams are focused by the plus lens 25, a linear shape formed on the surface of the photosensitive drum 10 can become longer.

Therefore, there is an advantage in that areas, which can be simultaneously printed, increase more due to the minus lens 27.

Figure 11:
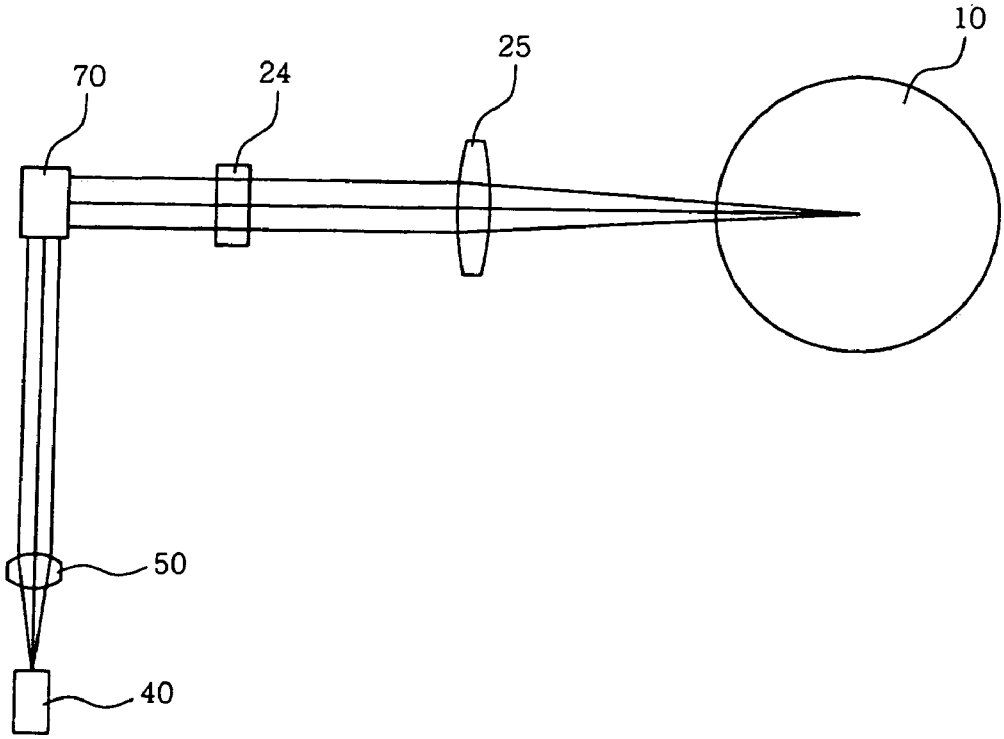
FIG. 11 is a view showing an embodiment in which the light beam scanning apparatus of FIG. 4 is combined with an optical modulator.

FIG. 11 is a view showing the light beam scanning apparatus according to a preferred embodiment of the present invention.

Referring to FIG. 11, the light beam scanning apparatus is implemented so that light beams scanned from an image head form spots on a photosensitive drum to form an image. The image head comprises a light emitting source 40, a collimator lens 50 for converting a light beam emitted from the light emitting source to a parallel beam, an optical modulator 70 for modulating the light beam, converted to the parallel beam by the collimator lens to generate multiple beams, and a lens system for allowing the multiple beams output from the optical modulator to form spots on the surface of the photosensitive drum in a linear shape along a vertical direction of the surface thereof.

According to the embodiment of the present invention, a single light emitting source 40 consisting of LDs or LEDs is used. A Light beam emitted from the light emitting-source 40 is converted to a parallel beam by the collimator lens 50, and an electrical signal of the parallel beam is modulated to an image signal by an optical modulator 70.

Figure 12A:
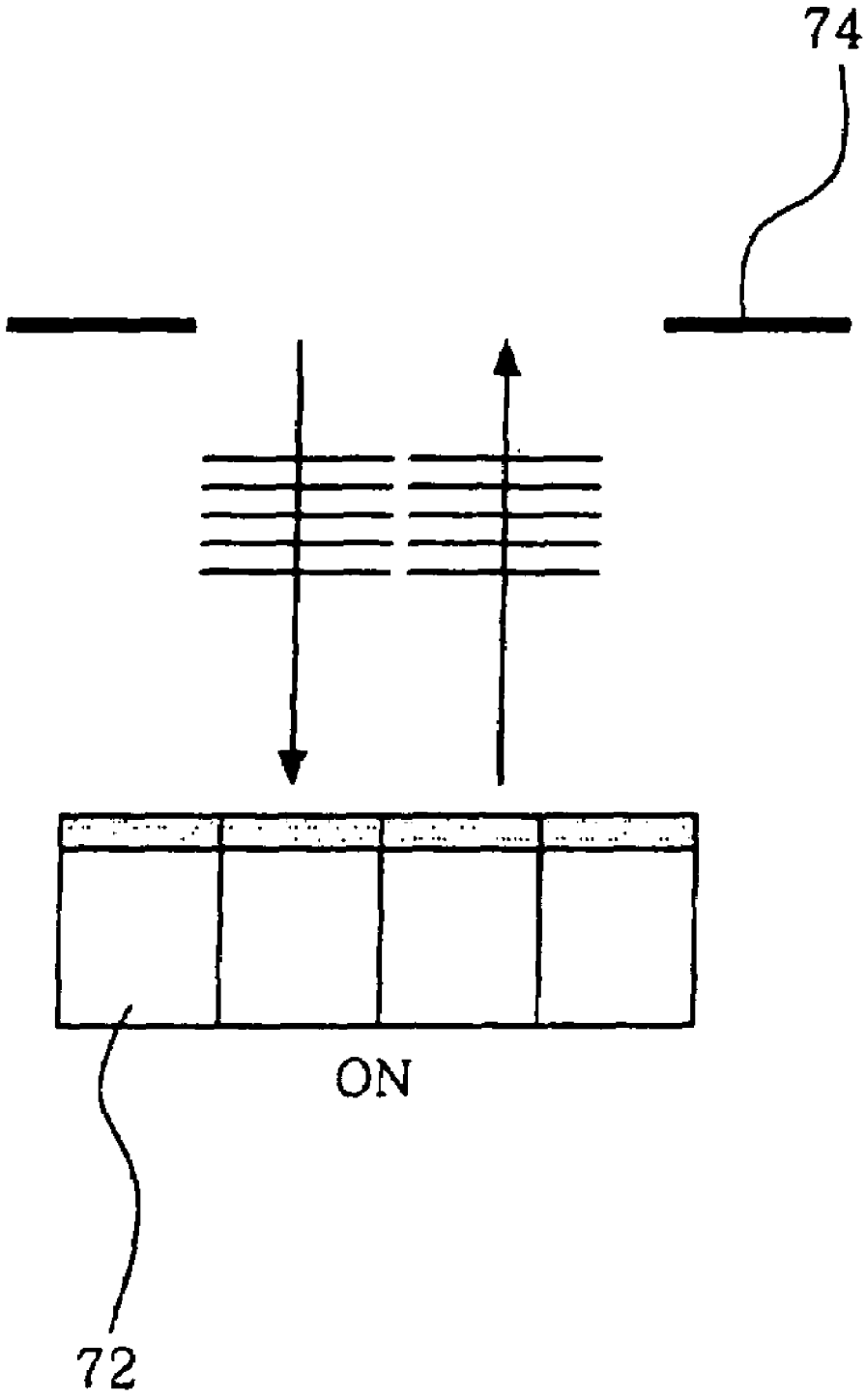
FIG. 12 is a view showing the optical modulator according to the present invention.
Figure 12B:
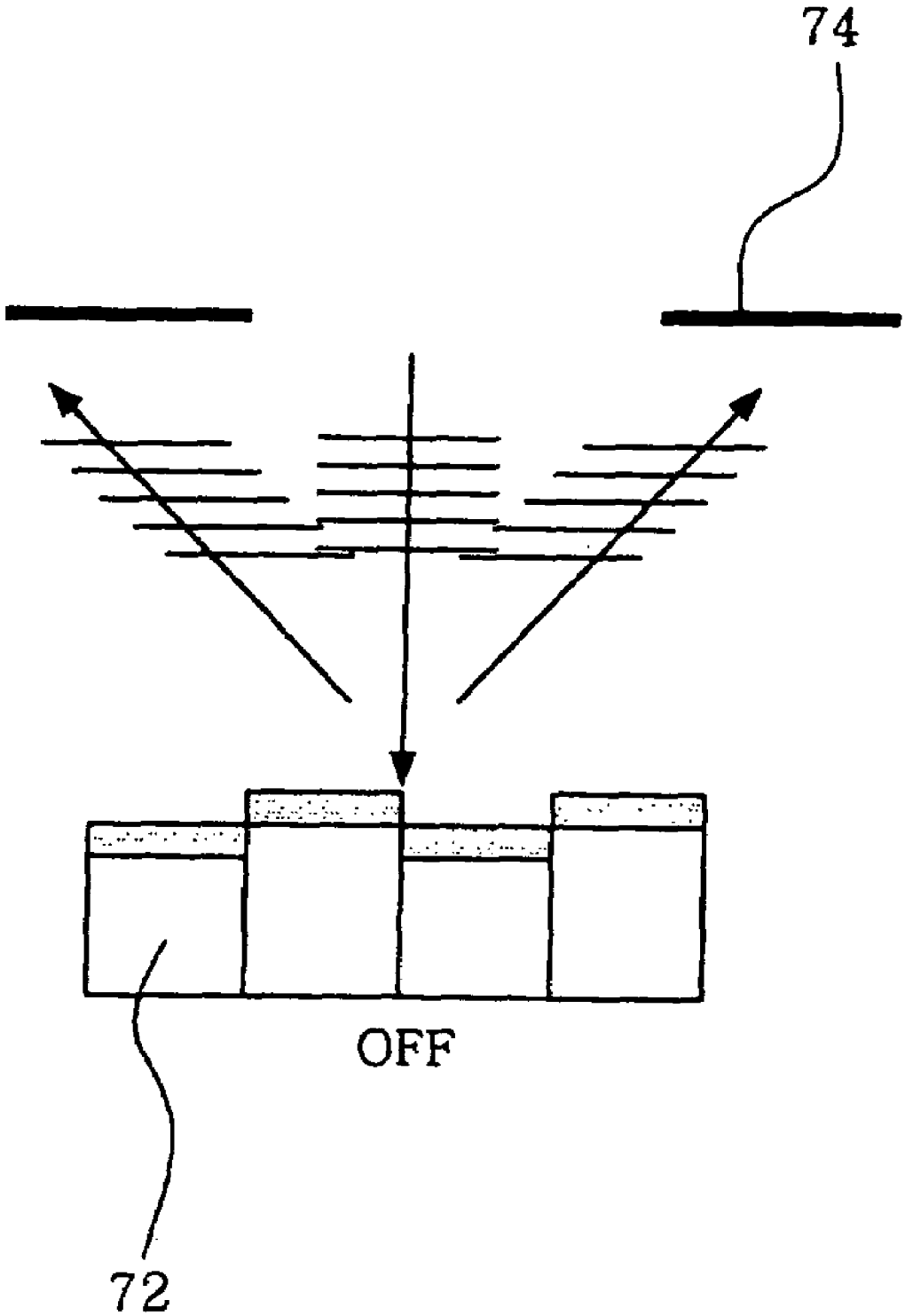

The optical modulator 70 is a device for modulating incident light by diffracting the incident light. As shown in FIG. 12*a*, if a voltage is not applied, diffraction does not occur and an ON mode is performed. Therefore, upper surfaces of all cells 72 of the optical modulator 70 are even, so that the same effect as a mirror is obtained, thus reflecting light perpendicularly incident on the upper surfaces of the cells 72 as it is. However, if an electric field is applied to the cells 72, cells 72 supplied with a voltage show a grating structure as shown in FIG. 12*b*, thus diffracting perpendicularly incident light to perform an OFF mode. Further, diffracted light is blocked by slits 74. This linear cell array forms the optical modulator to convert an electrical image signal to an optical image signal.

As described above, light beams converted to the image signal by the optical modulator 70 pass through the above-described path to form continuous spots in a linear shape on the surface of the photosensitive drum.

That is, multiple beams output from the optical modulator 70 are refracted only in the main scanning direction by the cylinder lens 24, so that the positions of focuses vary when viewed in the main scanning direction and the sub-scanning direction, respectively. Further, the multiple beams can selectively pass through the minus lens 27. The focus of light beams viewed in the main scanning direction exists at the surface of the photosensitive drum 10 and the focus of light beams viewed in the sub-scanning direction exists at the central axis of the photosensitive drum 10 by the plus lens 25.

As described above, the present invention provides a light beam scanning apparatus, in which an LD array within an image head is arranged to be perpendicular to a rotation axis of a photosensitive drum, thus simultaneously printing two or more lines to increase a printing speed and obtaining a uniform image.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A light beam scanning apparatus, in which light beams scanned from an image head form spots on a photosensitive drum to form an image, the image head comprising:

light emitting means comprised of a plurality of light emitting sources arranged to be perpendicular to a rotation axis of the photosensitive drum to output multiple beams in response to video signals; and a lens system for allowing the multiple beams output from the light emitting means to form spots on a surface of the photosensitive drum in a linear shape along a vertical direction of the surface thereof, wherein a focus of light beams having passed through the lens system is formed at a central axis of the photosensitive drum when viewed in a sub-scanning direction, thus enabling spots of the light beams to be vertically formed on the surface of the photosensitive drum in a linear shape when viewed in a main scanning direction.

2. The light beam scanning apparatus according to claim 1, wherein the lens system comprises:

a collimator lens for converting the multiple beams emitted from the light emitting means to parallel beams;

a cylinder lens for refracting beams the multiple beams, converted to the parallel beams by the collimator lens, in the main scanning direction; and a plus lens for focusing the multiple beams having passed through the cylinder lens on the photosensitive drum.

3. The light beam scanning apparatus according to claim 1 or 2, wherein the light beams are scanned perpendicularly to the surface of the photosensitive drum in the main scanning direction, and intervals between the spots formed by the light beams are regular.

4. The light beam scanning apparatus according to claim 1 or 2, wherein the light beams viewed in the main scanning direction have a waist (W) satisfying a condition of $W>r(1-\cos\phi)\tan\theta$, wherein "r" represents a radius of the photosensitive drum;

"$\phi$" represents an angle between a central ray having passed through a central axis of the lens system and incident on the photosensitive drum when viewed in the sub-scanning direction, and a marginal ray focused from an uppermost portion of the lens system and incident on the photosensitive drum when viewed in the sub-scanning direction; and "$\theta$" represents an angle between a central ray passing through a central axis of the lens system when viewed in the main-scanning direction, and a marginal ray focused from the uppermost portion of the lens system and incident on the photosensitive drum when viewed in the main-scanning direction.

5. The light beam scanning apparatus according to claim 2, wherein the focus of the light beams viewed in the sub-scanning direction is located at the central axis of the photosensitive drum and the spots of the light beams viewed in the main scanning direction are vertically formed on the surface of the photosensitive drum in a linear shape by controlling a curvature of the cylinder lens, a distance between the cylinder lens and the plus lens, and a focal length of the plus lens in conjunction with each other.

6. The light beam scanning apparatus according to claim 2, wherein the cylinder lens and the plus lens are implemented by a single equivalent lens, which has different dioptric powers in the main scanning direction and the sub-scanning direction, and in which a focus of light beams focused by the equivalent lens is located at the central axis of the photosensitive drum when viewed in the sub-scanning direction, and spots of the light beams are vertically formed on the surface of the photosensitive drum in a linear shape when viewed in the main scanning direction.

7. The light beam scanning apparatus according to claim 6, wherein the equivalent lens is a Y-toric, aspheric lens.

8. The light beam scanning apparatus according to claim 2, further comprising a minus lens disposed between the cylinder lens and the plus lens to outwardly diffract light beams passing through the cylinder lens.

9. A light beam scanning apparatus, in which light beams scanned from an image head form spots on a photosensitive drum to form an image, the image head comprising:

a light emitting source;

a collimator lens for converting a light beam emitted from the light emitting source to a parallel beam;

an optical modulator for modulating the light beam, converted to the parallel beam by the collimator lens, to generate multiple beams; and a lens system for allowing the multiple beams output from the optical modulator to form spots on a surface of the photosensitive drum in a linear shape along vertical direction of the surface thereof, wherein a focus of light beams having passed through the lens system is formed at a central axis of the photosensitive drum when viewed in a sub-scanning direction, thus enabling spots of the light beams to be vertically formed on the surface of the photosensitive drum in a linear shape when viewed in a main scanning direction.

10. The light beam scanning apparatus according to claim 9, wherein the lens system comprises:

a cylinder lens for refracting the multiple beams output from the optical modulator in the main scanning direction; and a plus lens for focusing multiple beams having passed through the cylinder lens on the photosensitive drum.

11. The light beam scanning apparatus according to claim 9 or 10, wherein the light beams are scanned perpendicularly to the surface of the photosensitive drum in the main scanning direction, and intervals between the spots formed by the light beams are regular.

12. The light beam scanning apparatus according to claim 9 or 10, wherein the light beams viewed in the main scanning direction have a waist (W) satisfying a condition of $W>r(1-\cos\phi)\tan\theta$, wherein "r" represents a radius of the photosensitive drum.

"ϕ" represents an angle between a central ray having passed through a central axis of the lens system and incident on the photosensitive drum when viewed in the sub-scanning direction, and a marginal ray focused from an uppermost portion of the lens system and incident on the photosensitive drum when viewed in the sub-scanning direction; and "θ" represents an angle between a central ray passing through a central axis of the lens system when viewed in the main-scanning direction, and a marginal ray focused from the uppermost portion of the lens system and incident on the photosensitive drum when viewed in the main-scanning direction.

13. The light beam scanning apparatus according to claim 10, wherein the focus of the light beams viewed in the sub scanning direction is located at the central axis of the photosensitive drum and the spots of the light beams viewed in the main scanning direction are vertically formed on the surface of the photosensitive drum in a linear shape by controlling a curvature of the cylinder lens, a distance between the cylinder lens and the plus lens, and a focal length of the plus lens in conjunction with each other.

14. The light beam scanning apparatus according to claim 10, wherein the cylinder lens and the plus lens are implemented by a single equivalent lens, which has different dioptric powers in the main scanning direction and the sub-scanning direction, and in which a focus of light beams focused by the equivalent lens is located at the central axis of the photosensitive drum when viewed in the sub-scanning direction, and spots of the light beams are vertically formed on the surface of the photosensitive drum in a linear shape when viewed in the-main scanning direction.

15. The light beam scanning apparatus according to claim 14, wherein the equivalent lens is a Y-toric, aspheric lens.

16. The light beam scanning apparatus according to claim 10, further comprising a minus lens disposed between the cylinder lens and the plus lens to outwardly diffract light beams passing through the cylinder lens.

17. An image forming system comprising the light beam scanning apparatus of claim 1 or 9.

* * * * *